US006600255B1

(12) United States Patent
Kai et al.

(10) Patent No.: US 6,600,255 B1
(45) Date of Patent: Jul. 29, 2003

(54) COIL FILAMENT STRUCTURE FOR AN INCANDESCENT LAMP

(75) Inventors: Kenzo Kai, Himeji (JP); Minoru Asao, Tatsuno (JP); Katuhiko Miyahara, Himeji (JP); Hiroshi Sugahara, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/743,804

(22) PCT Filed: May 22, 2000

(86) PCT No.: PCT/JP00/03248

§ 371 (c)(1),
(2), (4) Date: Jan. 22, 2001

(87) PCT Pub. No.: WO00/72357

PCT Pub. Date: Nov. 30, 2000

(30) Foreign Application Priority Data

May 24, 1999 (JP) ..... 11-144122

(51) Int. Cl.[7] ..... H01J 1/88
(52) U.S. Cl. ..... 313/271; 313/441; 313/631
(58) Field of Search ..... 313/441, 631, 313/271

(56) References Cited

U.S. PATENT DOCUMENTS 4,598,342 A * 7/1986 English et al. ..... 313/579
4,959,585 A * 9/1990 Hoegler et al. ..... 313/631

FOREIGN PATENT DOCUMENTS

| | | |
|---|---|---|
| JP | 31194 | 6/1917 |
| JP | 353826 | 2/1948 |
| JP | 36-22276 | 3/1961 |
| JP | 4-73859 | 3/1992 |
| JP | 9-134707 | 5/1997 |

* cited by examiner

*Primary Examiner*—Vip Patel
(74) *Attorney, Agent, or Firm*—Nixon Peabody LLP; David S. Safran

(57) ABSTRACT

In order to provide an incandescent lamp in which an unlit state of the lamp caused by a hang-out of the coil as well as a short lifetime thereof are prevented using a simple construction and its lifetime in practical application is long, a coil (21)-like filament (20) is held in a bulb (11) by upholding parts (30, 30') with an axis of the coil (21) being oriented in a vertical direction, and a coil pitch of the coil (21) at the upper part thereof is made narrow as compared with that of the lower part of the filament (20). Or the filament (20) of the incandescent lamp (10) is constituted by the coil (21) of a conical shape or that of a frustum of a circular cone, and the filament is arranged within the bulb (11) in such a way that it may be held by upholding parts (30, 30') with an axis of the coil (21) of the filament (20) being oriented in a vertical direction and the one end of the oil (21) having a smaller diameter being positioned upward.

2 Claims, 4 Drawing Sheets

COIL FILAMENT STRUCTURE FOR AN INCANDESCENT LAMP

TECHNICAL FIELD

This invention relates to an incandescent lamp at is turned on with a coil axis of a filament being directed in a vertical direction, and, for e ample, an incandescent lamp filled with inert gas containing halogen.

BACKGROUND ART

In the case of a usual incandescent lamp of the one-end sealed type which is widely used, for example, a coil-like filament within a cylindrical glass bulb is connected to upholding parts also acting as an inner lead wire at both ends of the filament, and the filament is held and arranged in such a way that a bulb axis of the bulb and an axis of the coil are coincident with each other.

In the case of such an incandescent lamp as described above, the lamp is turned on while it is kept in a vertical orientation. In doing so, it may sometimes happen that, when the time of the turning-on operation expires, the coil of the filament is extended and hangs out.

In particular, in the case of an incandescent lamp with the coil axis of the filament being oriented in a vertical direction as described above, a load corresponding to the weight of the coil itself is applied to the filament, resulting in that the stress of the net weight of the filament increases from the lower end of the filament to its upper end and the coil hangs out considerably at the upper end of the filament.

Since both upper and lower ends of the filament of the incandescent lamp as described above are held and fixed by the upholding parts, the filament length and the number of turns of the coil however do not change, and when the coil hanging-down state is generated above the filament the pitch of the coil positioned further below is gradually narrowed and the coils which are present adjacent to each other in a vertical direction get in contact with each other. As a result, a short-circuit state or a melting cut of the filament occurred and turned off the lamp resulting in the problem of making the lamp life short.

In particular, in the case of an incandescent lamp in which the turning-on or turning-off operation was repeated within a short period of time under such a high temperature that the temperature of the filament exceeded 2600° C., for example, and the lamp was turned on in a periodic manner, the hang-down of the coil was produced remarkably often and caused the lifetime of the lamp to become quite short.

In view of the aforesaid problem, it is also possible to fix the upholding parts not only to the upper and the lower ends of the filament, for example, but also over a longitudinal direction of the filament and to prevent the coils from getting in contact with each other. However, application of such a prior art method as described above causes the structure of the filament to become a complicated structure and further its productivity to become quite poor.

In addition, in the case that the incandescent lamp is utilized as a heat source, in particular in the case that the filament of the incandescent lamp has a size relation wherein the length of the filament and the diameter of the coil are identical with each other, this may cause the thermal efficiency of the lamp to be reduced, resulting in that it is preferable that the number of upholding parts is as low as possible.

In view of the foregoing, it is an object of the present invention to provide an incandescent lamp in which an unlit state as well as a short lifetime of the lamp and a hang-out of the coil is prevented by a simple configuration and its lifetime in practical application is long.

DISCLOSURE OF INVENTION

In view of the foregoing, in a first aspect of the present patent application there is provided an incandescent lamp in which a coil-like filament is stored in a bulb and the filament is held by upholding parts with an axis of the coil being oriented in a vertical direction, wherein the coil is made such that a coil pitch at the upper part of the filament is made narrower than a coil pitch at the lower part of the filament.

With such an arrangement as above, when the coil hangs out considerably as described above at the upper part of a usual filament and the coil extends to hang down, the pitch of the coil is made narrow at the lower side of the filament resulting in that the filament may contact the coil. In accordance with the first invention, the upper coil is wound more closely than the lower coil of the filament without changing the filament length or the number of turns of the coil, the coil pitch of the upper coil of the filament is made narrower in advance than that of the lower coil in anticipation of a deformation of the coil, and the pitch of the lower coil of the filament is wound wide. In doing so, even if the coil hangs out to cause the pitch of the lower coil to be narrowed, it requires a lot of time until the coils themselves get in contact with each other, so that the contact of the coils can be avoided and, further, it becomes possible to prevent a short-circuit state and a melting cut of the filament. Then, as a result, it is possible to prevent an unlit state of the lamp and attain a long lifetime of the lamp.

Further, in a second aspect of the present patent application there is provided an incandescent lamp in which a coil-like filament is stored in a bulb and the filament is held by the upholding parts with an axis of the coil being arranged in a vertical direction and wherein the coil has a conical shape or its shape is a frustum of a circular cone and it is arranged with its one end having a smaller coil diameter being placed to the upside. With such an arrangement as above, since the shearing force applied to the coil is reduced relative to the axial load of the coil as the coil diameter is decreased, resistance against the stress applied to the coil, i.e. the anti-hang out characteristic, is increased. Accordingly, even if the load is increased from the lower end of the filament to the upper end thereof, a gradual reduction of the coil diameter causes the anti-hang out characteristic of the coil to be increased and, accordingly, the hang-out of the coil can be effectively restricted. Thus, deformation caused by the hang-out of the coil is hardly produced even at the upper part of the filament so that it is possible to prevent the coil pitch below the filament from being narrowed, and it is also possible to avoid contact between the coils themselves.

As a result, it is possible to prevent a short-circuit state and melt-cut of the filament, to prevent an unlit state of the lamp and to attain a long lifetime of the lamp. Even if a remarkable hang-out of the coil is produced, it is possible to extend the lifetime of the lamp.

BEST MODE FOR CARRYING OUT THE INVENTION

Figure 1:
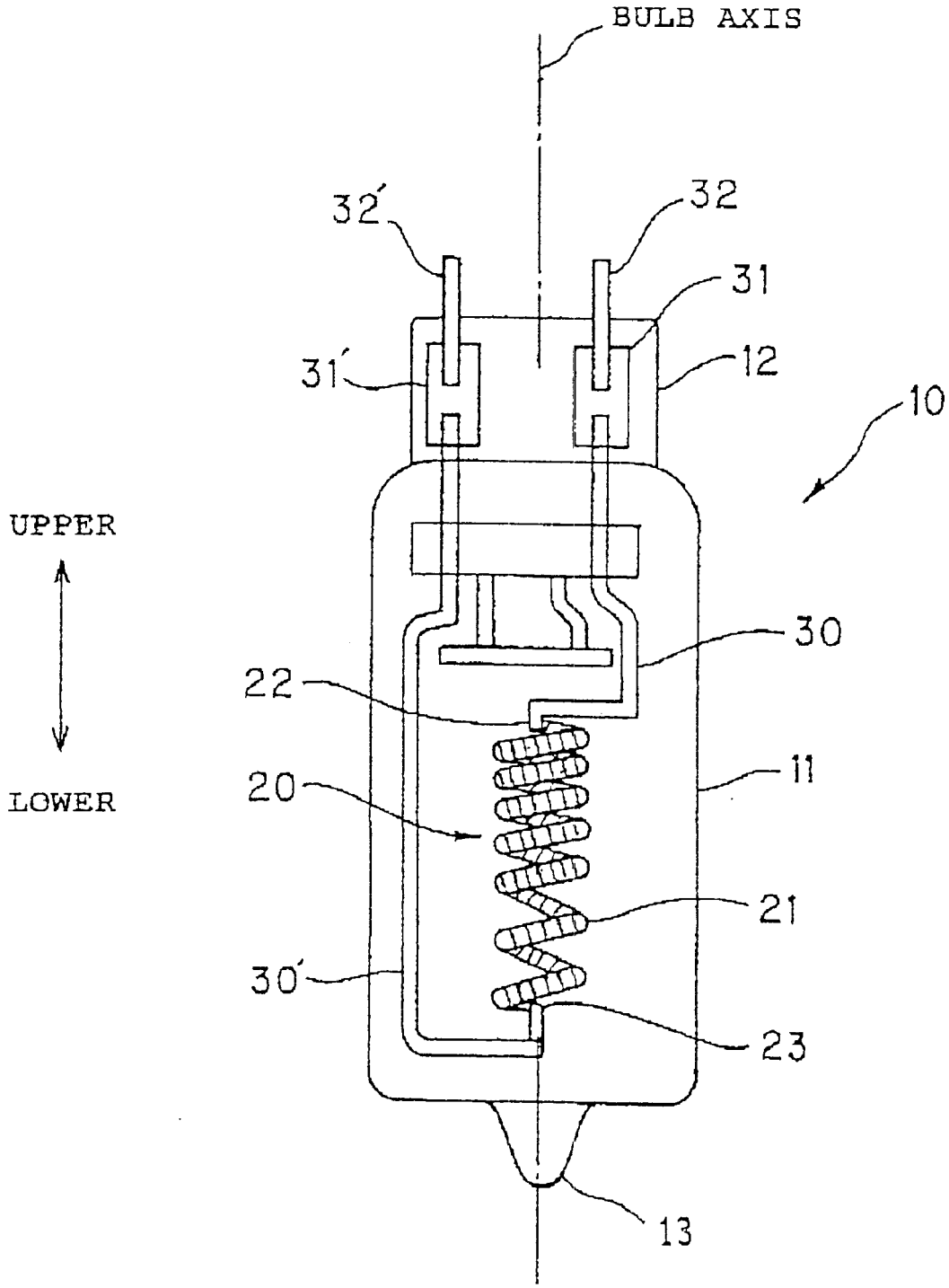
FIG. 1 is a sectional view showing an incandescent lamp of a preferred embodiment of the first inventive aspect.

FIG. 1 shows an incandescent lamp of a preferred embodiment of the first present invention, wherein an incandescent lamp 10 is a so-called one end sealed type halogen lamp constructed such that a double-coil type filament 20 is a arranged inside a glass bulb 11, inert gas containing halogen is filled therein and at the same time a sealing part 12 is formed at one end of the bulb 11 and a tip part 13 of a residual evacuation tube is formed at the other end of the bulb.

This incandescent lamp 10 is mounted with the bulb axis of the bulb 11 being arranged in a substantially vertical direction, and it is lit, for example, in a vertical orientation with the sealing part 12 being placed up as shown in FIG. 1.

Upholding parts 30, 30' connected to the upper end and the lower end of the filament 20 are connected to molybdenum foils 31, 31' embedded in the sealing part 12. The molybdenum foils 31, 31 ' are connected to outer lead rods 32, 32' projecting out of the bulb 11. These upholding parts 30, 30' hold the filament 20 and also act as inner lead wires for supplying electricity to the filament 20.

The coil 21 constituting the filament 20 is comprised of a double coil, for example, in which a strand is wound doubly. The coil 21 is made such that a tungsten wire with a strand diameter of $\phi$0.22 mm is wound at an equal pitch with a diameter of 0.98 mm to form a primary coil, and then this primary coil is wound a second time with a coil diameter R=4.8 mm while its pitch is being displaced in a direction of the coil winding axis. This coil 21 is applied for use with 6 to 7 turns as the number of windings, for example.

Figure 2:
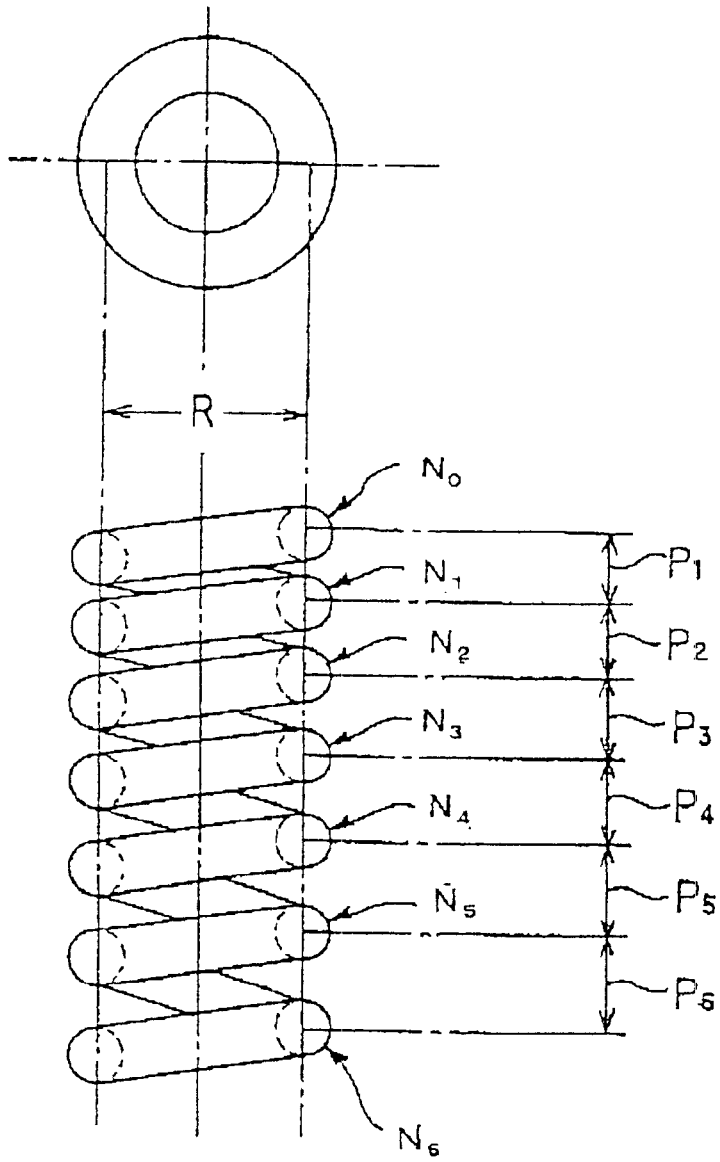
FIG. 2 is an enlarged illustration showing a filament segment of FIG. 1.

Referring now to FIG. 2, a constitution of the filament 20 will be described as follows. In FIG. 2, for the sake of convenience in illustration, an enlarged view showing a single winding coil is employed.

The upper part and the lower part of the filament 20 are wound using a different pitch of the coil 21, respectively. The pitch in the upper part is narrower than the pitch in the lower part. As a practical example of numerical values, the pitch $P_1$ from a winding start point $N_0$ of the coil 21 to the point $N_1$ one turn wound from the point $N_0$ is 0.98 mm, and, consecutively in the same manner, the pitch $P_2$ just below is 1.16 mm. Further, the pitch $P_3$ just below is 1.34 mm . . . , and the pitch is made to be wider every time the coil 21 is wound.

In the prior art type incandescent lamps, the coil pitch at the upper end of the filament becomes wide as the coil hangs out so that the pitch is gradually narrowed as it is directed more downwardly and the filament is short-circuited at an early time.

However, in accordance with the first invention, even if the coil 21 hangs out, the coil pitch is gradually widened in a downward direction, so that it is possible to avoid that the coils 21 adjacent to each other in a vertical direction get in contact in a longitudinal direction of the filament 20, and so it becomes possible to prevent the occurrence of a short-circuit and a melt-cut of the filament 20.

As a result, an early unlit state of the lamp can be prevented and a lifetime of the lamp can be extended.

Figure 3A:
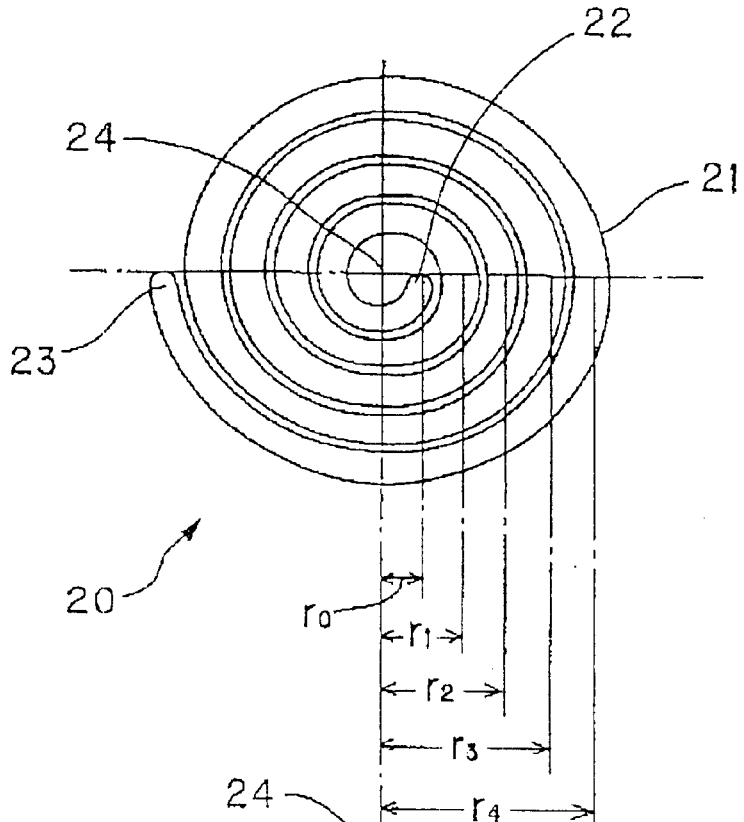
FIGS. 3(*a*) and 3(*b*) are views showing a filament in an incandescent lamp of the second aspect of the present invention, wherein FIG. 3(*a*) is a view showing this filament from above and FIG. 3(*b*) is a view showing this filament from a lateral side.
Figure 3B:
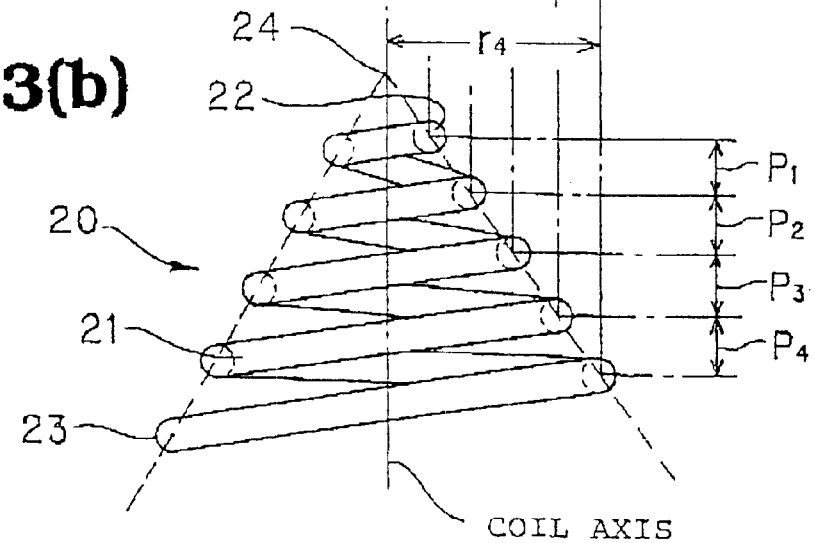

Subsequently, a preferred embodiment of the second present invention will be described. FIG. 3 is a figure in which the filament 20 indicating the essential part of the second invention is extracted, wherein FIG. 3(*a*) is a view in which the filament 20 is seen from above and FIG. 3(*b*) is a view in which the filament 20 is seen from a lateral side.

The filament 20 is made such that a tungsten wire is wound with its diameter being varied in sequence in an axial direction of the coil, wherein its outer appearance is a conical (or also called a frustum of a circular cone) coil 21.

The filament 20 in accordance with the second invention is a coil 21 having a pitch angle constant, for example, and a radius r (mm) of the coil of the filament 20 in the figure is $r_4$=2.33, for example. Thus, the radius becomes small in an upward direction every time the wire is wound by one turn and, more practically, the diameter of the coil 21 is gradually decreased like $r_3$=2.18, $r_2$=2.02 . . . . Then, at the upper end 22, radius of $r_0$=1.70, for example, is attained.

Further, a pair of upholding parts, not illustrated, are fixed to the upper end 22 and the lower end 23 of the coil 21 in the filament 20, and the filament 20 is arranged in the bulb with the coil axis being directed in a vertical direction, the upper part 22 of the coil 21 being placed upward and the lower end 23 of the coil 21 being placed downward in such a way that the conical top part 24 of the coil 21 is positioned in an upward direction.

Further, in the preferred embodiment of the second present invention, although a description of the entire structure of the incandescent lamp has been omitted, the other components of the incandescent lamp except the filament 20 (e.g. the bulb, filled-in gas or the upholding parts and the like) are the same as those of the first preferred embodiment described above.

If the diameter of the upper side coil, with the coil axis being oriented in a vertical direction, is small in comparison with that of the lower coil, as disclosed in the second present invention, the hang-out of the coil at the filament top can be advantageously restricted. That is, since the resistance against the hang-out of the coil to the stress applied to each of the segments of the coil can be increased, a deformation of the coil is hardly produced and the coil pitch also at the lower side of the filament is hardly narrowed.

As a result, the coils of the filament themselves can be prevented from getting in contact with each other so that it becomes possible to prevent a short-circuit state and a melt-cut resulting from the contact of the filaments, and it is possible to prevent the lamp from going out. Further it becomes possible to attain a long lifetime of the lamp.

Further, the second present invention is satisfactory when the outer appearance of the filament is a conical shape (or a frustum of a circular cone) so that it does not pose any problem at all if the coil diameter is not displaced at a specified rate in an axial direction of the coil of the filament.

In addition, the second present invention does not pose any problem at all, at the time the lamp is used in a lit state, when the coil diameter in the upper part of the filament is small, and so various kinds of modifications can be carried out.

In FIG. 3(*b*), it does not pose any problem at all even if the coil pitches ($P_1$ to $P_4$) are displaced in an axial direction of the coil, and it is also possible to combine the second present invention with the first present invention, for example. That is, it is also applicable that the coil having a conical shape as its outer appearance is provided as shown in FIG. 3(*b*), and the coil pitches ($P_1$ to $P_4$) are gradually widened from the upper part to the lower part of the filament.

As described above, if the first present invention is combined with the second present invention, it can be expected that the long lifetime of the lamp is improved even more. That is, in addition to the effect that the anti-hang-out characteristic against the load of the coil is increased by setting the coil diameter at the upper part of the filament small in comparison with that of the lower part, it becomes possible to avoid a contact of the coil for a long period of time by keeping the coil pitch at that portion wide in advance even if the coil hangs out due to the use of the lamp for a long period of time, and the coil pitch at the lower part is made narrow as compared with that of the not yet use lamp, so that it is advantageously possible to prevent the disadvantage of a short-circuit or a melt-cut of the filament. As a result, with regard to the long lifetime of the lamp, it becomes possible to attain a remarkable effect.

It is of course apparent that the aforesaid first as well as the second present invention can be modified occasionally and the numerical values or the like are not restricted to the aforesaid values and other constitutions may also be modified. For example, whatever coils of the filament, i.e. a single coil or a double coil, may be applied, the present invention can be performed.

Embodiments

In the first present invention, the variation of the coil pitch can be easily determined by applying the following equation.

$$P_n=a(2\pi n)^{m-1}$$

(where a is an optional constant, 1<m[3).

This embodiment will be described as follows.

Figure 4:
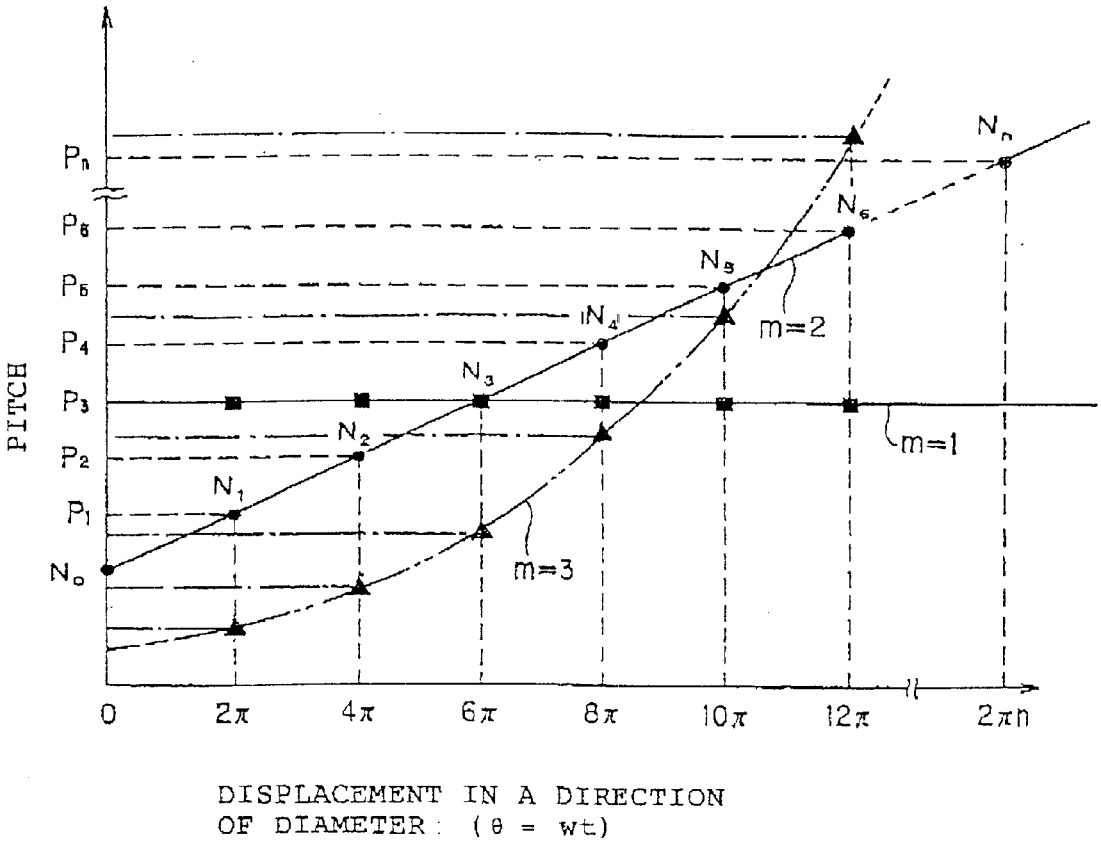
FIG. 4 is a diagram showing a relation between a displacement in a diameter direction and a pitch $P_n$.

FIG. 4 is a view indicating a relation between a displacement $\upsilon$ in a diameter direction from a start point $N_0$ and a pitch $P_n$ in an optional point $N_n$ where a number of turns (n) are wound on the coil from a winding start point $N_0$ of the coil. In this case, the pitch $P_n$ at the point $N_n$ denotes a pitch between the point $N_{n-1}$ and the point $N_n$.

When the wire moves on in the coil by one pitch, it turns once on the coil in a direction of the diameter to be displaced by $2\pi$, so that a displacement in a direction of the diameter from the start point $N_0$ to the point $N_n$ can be expressed in general as $\upsilon_n=2\pi n$.

In this case, an optional point on the coil is expressed by its coordinates. First, if it is assumed that points on a circle drawn with the coil radius (r) are defined as X, Y, the coil axis is defined as the Z axis and a longitudinal position is defined as Z, each of X and Y can be expressed as $$X=r\cos\upsilon,\ Y=r\sin\upsilon,\ Z=k\upsilon^m$$

(where k and m are optional constants).

Accordingly, the pitch between the two points can be obtained from the aforesaid equation Z, wherein a displacement $\upsilon_n$ in a direction of the diameter at the point $N_n$ can be expressed as n. That is, it is possible to express the pitch $P_n$ between the point $N_{n-1}$ and the point $N_n$ by the following equation with the use of the number of turns (n) of the coil.

$$P_n=a(2\pi n)^{m-1}\text{(a and m are optional constants)}$$

where, in this equation, if m=1 is applied, an equation of $P_n$=a (a constant) is obtained, and in this case this equation indicates that the coil pitch is constant. Subsequently, if the value of m exceeds 1, the pitch is increased from the upper end to the lower end of the coil so that the first present invention can be preferably utilized within a range of 1<m.

If it is assumed that a relation of m=2 is applied, for example, a pitch $P_n=2\pi an$ is obtained so that the pitch can be expressed by a linear function of the number of turns (n) of the coil, and the pitch is widened by the same width from the upper end to the lower end of the coil. In addition, if it is assumed that a relation of m=3 is applied, the pitch is increased in a quadratic function versus the number of turns.

However, if the value of m is too high, this value may exceed a specification of the incandescent lamp and the aforesaid equation cannot be applied. The present inventors performed an analysis on the value of m satisfying the specification of the prior art incandescent lamp and capable of applying the aforesaid equation and found that the present invention can be sufficiently performed by setting the constant (a) low when the equation of m=3 is applied. Thus, it can be understood that the present invention can be carried out in case the value of m is 3 or less.

With the result of the aforesaid equation, the following equation can be realized.

$$P_n=a(2\pi n)^{m-1}$$

(where a is an optional constant, 1<m*3)

Further, the present inventors have found that the widest pitch $P_{max}$ is most preferable in a range of $$P_{min}<P_{max}*3\times P_{min}$$

with respect to the narrowest pitch $P_{min}$.

In the case that a rate of narrowing the coil pitch in the first present invention is rather large at the lower end of the coil and small as it is lowered toward the upper end thereof, it is possible to calculate briefly a pitch corresponding to an amount of deformation of the coil by applying a gradual displacement of the coil pitch while satisfying the aforesaid equation.

As a result, it is possible to avoid contact between the coils over the entire length of the filament and it becomes possible to attain an incandescent lamp having a long lifetime.

Industrial Applicability

As described above, the incandescent lamp of the present invention is applied in all kinds of usual incandescent lamps lit with a coil axis of the filament being oriented in a vertical direction, and the present invention is useful for an incandescent lamp where the temperature of the filament is 2600° C. or more, for example, and wherein the turning-on or turning-off operation is repeated at such a high temperature as above within a short period of time and wherein the filament easily hangs out. Further the present invention is particularly suitable for an incandescent lamp filled with inert gas containing halogen utilized in a rapid thermal processing (RTP) applied in manufacturing of a semiconductor device.

What is claimed is:

1. An incandescent lamp in which a coiled filament is stored in a bulb having a sealing part and said coiled filament is held by upholding parts at an upper part adjacent the sealing part and a lower part such that an axis of said coiled filament is oriented in a vertical direction, wherein said coiled filament has a narrower coil pitch at the upper part adjacent the sealing part than the coil pitch at the lower part thereof.

2. An incandescent lamp in which a coiled filament is stored in a bulb having a sealing part and said coiled filament is held by upholding parts at an upper part adjacent the sealing part and a lower part such that an axis of said coiled filament is oriented in a vertical direction, wherein said coiled filament has either a conical shape or a frustum shape of a circular cone, and said coiled filament has a smaller coil diameter at the upper part adjacent the sealing part than the coil diameter at the lower part thereof.

* * * * *